US006619504B2

(12) United States Patent
Ozimec

(10) Patent No.: US 6,619,504 B2
(45) Date of Patent: Sep. 16, 2003

(54) MULTIPLE ROLL HOLDER UNIT

(76) Inventor: John Ozimec, 542 Huron Street, Toronto Ontario (CA), M5R 2R7

( * ) Notice: Subject to any disclaimer, the term of this patent is extended or adjusted under 35 U.S.C. 154(b) by 39 days.

(21) Appl. No.: 10/043,802

(22) Filed: Jan. 10, 2002

(65) Prior Publication Data

US 2003/0127554 A1 Jul. 10, 2003

(51) Int. Cl.[7] ..... B65G 59/00
(52) U.S. Cl. ..... 221/115; 242/560.1
(58) Field of Search ..... 221/33, 112, 115, 221/296, 266, 196, 283, 195; 242/561, 560.3, 560, 560.1

(56) References Cited

U.S. PATENT DOCUMENTS 4,298,138 A * 11/1981 Oden ..... 221/115
5,765,719 A 6/1998 Upham et al. ..... 221/196

FOREIGN PATENT DOCUMENTS

JP 10201662 9/1997

* cited by examiner

*Primary Examiner*—Kenneth W. Noland
(74) *Attorney, Agent, or Firm*—Collard & Roe, P.C.

(57) ABSTRACT

A multiple roll holder unit has a magazine in which rolls are stacked, and an associated roll holder having retaining arms moveable on opposite sides of a roll holding area. Actuation of a transfer mechanism having upper and lower cup members hinged at one side with each other causes a transfer of a lowermost one of the rolls in the magazine to the roll holding area as the retaining arms are retracted and set back following the motion of the cup members, releasing at the same time a depleted roll possibly held by the roll holder.

17 Claims, 6 Drawing Sheets

MULTIPLE ROLL HOLDER UNIT

FIELD OF THE INVENTION

The present invention relates to roll dispensers and more particularly to a multiple roll holder unit for storing multiple rolls, for example toilet paper, towel rolls, etc., and dispensing them one at a time as needed in ready-to-use position.

BACKGROUND

Known in the art is U.S. Pat. No. 5,765,719 (Upham et al.) which show a roll dispenser and rack having a magazine in which rolls are stacked vertically. An arcuate paddle is mounted in the magazine near its open bottom to selectively obstruct and clear it. The paddle is provided with a lever which extends outwardly and slides through the peripheral wall of the magazine. The lever is operable to move the paddle along a semi-circular course at the ends of which the paddle faces respectively upwardly to hold the lowermost roll in the magazine, and downwardly to release the lowermost roll. The roll so released falls and is caught on both sides by a pair of retaining arms under the bottom opening of the magazine. The return of the paddle to close the bottom opening of the magazine pushes the roll in place between the retaining arms, ejecting at the same time a depleted roll possibly held by the arms.

The roll replacement in the rack is prone to unreliable results as it requires pressure to be applied to a replacement roll against a depleted roll. The diameter of the rolls is also a factor to be considered in the operation of the dispenser. Also, space is needed around the magazine so that a user can properly actuate the lever.

SUMMARY

An object of the invention is to provide a multiple roll holder unit which overcomes the above problems, and which is simple in construction and highly reliable and efficient.

According to the present invention, there is provided a multiple roll holder unit comprising a magazine having a roll loading opening and an inner compartment in which rolls loaded in the magazine lay in a substantially stacked arrangement. A roll holder extends on a lower portion of and in communication with the inner compartment of the magazine. The roll holder has a pair of roll retaining arms on opposite sides of a roll holding area, the roll retaining arms being moveable between a retracted position wherein the roll retaining arms are moved out of the roll holding area, and a roll engaging position wherein the roll retaining arms engage with and retain a roll in the roll holding area. A transfer mechanism is provided for transferring a lowermost one of the rolls in the magazine to the roll holding area of the roll holder. The transfer mechanism has upper and lower cup members hinged at one side with each other and having respective rotation axes extending for combined operation of the cup members between a rest position wherein the upper cup member is turned upwardly for receiving and holding the lowermost one of the rolls in the magazine while the lower cup member extends behind the roll holding area, and a transfer position wherein both cups are turned toward each other until the roll held by the upper cup member falls on the lower cup member while the upper cup member provides support to a next one of the rolls in the magazine. Means are also operatively associated with the cup members for moving the roll retaining arms between the retracted and roll engaging positions as the cup members are respectively set in the transfer and rest positions.

Preferably, the lower cup member has a transverse opening through which a depleted roll released by the roll holder falls when the cup members are operated from the rest position to the transfer position as a result of the roll holding arms moving from the roll engaging position to the retracted position. Preferably, a handle member downwardly projects from a side opposite to the hinged side of the lower cup member, to facilitate the operation of the transfer mechanism.

A detailed description of preferred embodiments is given herein below with reference to the following drawings, in which like numbers refer to like elements.

DETAILED DESCRIPTION OF THE PREFERRED EMBODIMENTS

Figure 1:
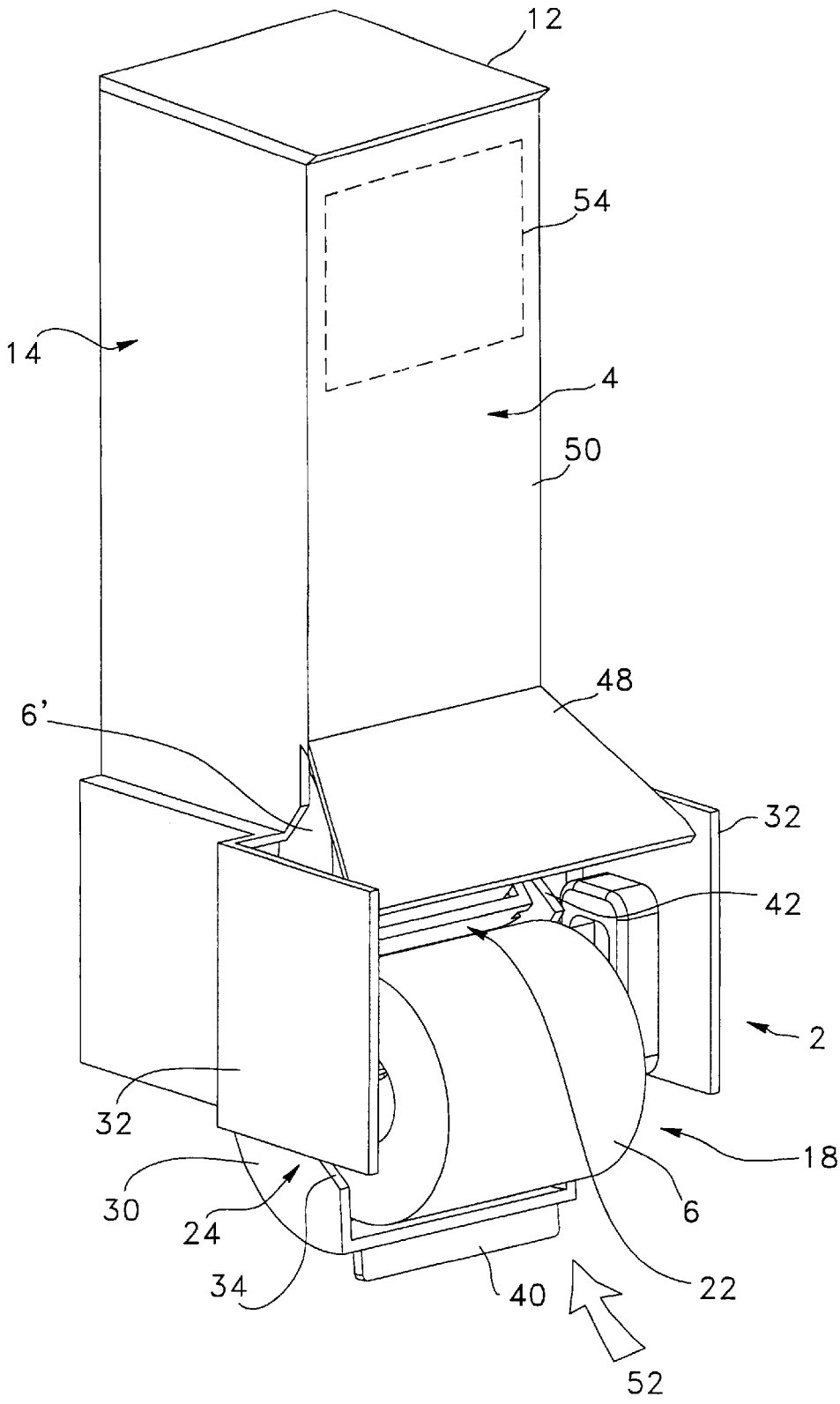
FIG. 1 is a perspective view illustrating a multiple roll holder unit according to the present invention.
Figure 5:
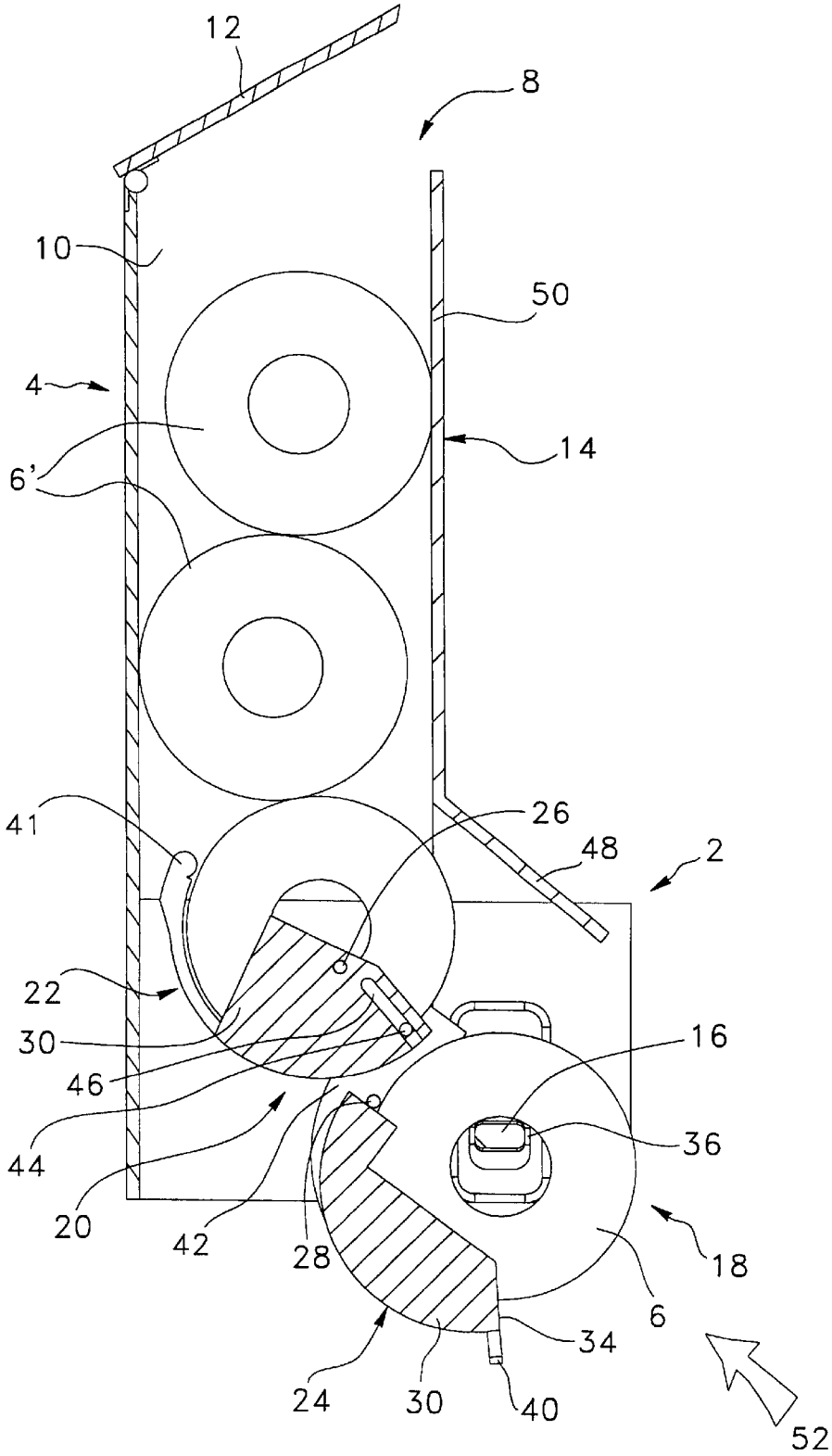

Referring to FIGS. 1 and 5, the multiple roll holder unit according to the present invention has a roll holder 2 and a magazine 4. The roll holder 2 is arranged to fulfil its usual purpose, i.e. holding a toilet paper roll 6 in the illustrated case ready for use. The magazine 4 is designed to store a number of rolls 6' for eventual replacement of the roll 6 in the roll holder 2 when it is depleted.

The magazine 4 has a roll loading opening 8 and an inner compartment 10 in which the rolls 6' lay in a substantially stacked arrangement. The roll loading opening 8 extends atop the inner compartment 10 of the magazine 4, and can be closed by a flap lid 12. Rolls 6' can thus easily be dropped into the inner compartment 10. Such a configuration is simple and effective for a unit which is mounted directly against the surface of a wall (not shown). In the case where the unit is mounted in a recess in the wall, the roll loading opening may be located on the front face 50 of the peripheral wall 14 just below the top of the unit as shown by dotted lines 54, for frontal loading. The unit may be provided with a surrounding trim (not shown) to conceal the outer edge of the hole forming the recess in the wall, and to lock the unit in place and preventing it from falling into the wall if need be. The opening 8 may be located elsewhere if necessary, provided that it allows the loading of rolls 6' in the magazine 4. The lid may take various forms, for example a removable lid, a sliding access door, etc. (not illustrated)

The inner compartment 10 of the magazine 4 preferably has a rectangular cross section generally matching a profile of the rolls 6' so that the rolls 6' loaded into the magazine 4 form a column and are prevented from moving sideways. However, the inner compartment 10 may have another shape, for example with a larger depth so that the rolls 6' are stacked in a zigzag arrangement (not illustrated) for a greater number in the magazine 4 for a same height.

The roll holder 2 extends on a lower portion of and in communication with the inner compartment 10 of the magazine 4. The roll holder 2 has a pair of roll retaining arms 16 on opposite sides of a roll holding area 18. The roll retaining arms 16 are moveable between a retracted position (see FIGS. 3 and 4) wherein the roll retaining arms 16 are moved out of the roll holding area 18, and a roll engaging position (see FIGS. 2 and 5) wherein the roll retaining arms 16 engage with and retain the roll 6 in the roll holding area 18.

A transfer device 20 is provided for transferring a lowermost one of the rolls 6' in the magazine 4 to the roll holding area 18 of the roll holder 2. The transfer device 20 has upper and lower cup members 22, 24 hinged at one side with each other (see FIG. 6) and having respective rotation axes 26, 28 extending for combined operation of the cup members 22, 24 between a rest position wherein the upper cup member 22 is turned upwardly for receiving and holding the lowermost one of the rolls 6' in the magazine 4 while the lower cup member 24 extends behind the roll holding area 18 (see FIG. 5), and a transfer position wherein both cup members 22, 24 are turned toward each other until the roll 6' held by the upper cup member 22 falls on the lower cup member 24 while the upper cup member 22 provides support to a next one of the rolls 6' in the magazine 4 (see FIG. 4). It should be noted that the term "behind" should not be taken in a strict sense, as the lower cup member 24 may extend more "below" or "beyond" the roll holding area 18 or in another position when the cup members 26, 28 are in the rest position, provided that it does not interfere with the dispensing of the roll 6 in the roll holding area 18.

An arrangement is operatively associated with the cup members 22, 24 for moving the roll retaining arms 16 between the retracted and roll engaging positions as the cup members 22, 24 are respectively set in the transfer and rest positions. An embodiment of the aforesaid arrangement is described hereinafter.

The cup members 22, 24 preferably have opposite roll guiding side flanges 30 guiding the rolls 6' from the magazine 4 to the roll holder 2. The roll holder 2 may take different configurations to fulfil its purpose. In the illustrated embodiment, it has opposite side walls 32 spaced from each other. The roll retaining arms 16 are respectively pivotally mounted onto facing sides of the side walls 32, and are arranged to have pivoting courses between the roll engaging and retracted positions wherein the roll retaining arms 16 are respectively directed toward each other (e.g. as in FIG. 2) and upwardly pivoted against the side walls 32 of the roll holder 2 (as in FIG. 4). The guiding side flanges 30 of the lower cup member 24 extend respectively along the inside facing sides of the side walls 32 of the roll holder 2 and have upper edges 34 producing a lifting action on, the roll retaining arms 16 as the cup members 22, 24 are moved from the rest position to the transfer position, thereby providing the aforesaid arrangement for moving the roll retaining arms 16. Other arrangements can also be used for this purpose if desired. For example, the pivotal motion of the roll retaining arms 16 can be achieved using an appropriate gearing mechanism (not illustrated) coupled to the cup members 22, 24 so that their displacement drives the gearing mechanism which causes the upward pivotal action of the roll retaining arms 16. Instead of pivoting, the roll retaining arms 16 may be arranged to slide out of the roll holding area 18 (not illustrated).

Spring elements 36 urging the roll retaining arms 16 into the roll engaging position can be provided to prevent the retaining arms 16 from remaining upstanding once the cup members 22, 24 are set back in the rest position.

The lower cup member 24 can conveniently have a transverse opening 38 through which a depleted roll 6 released by the roll holder 2 falls when the cup members 22, 24 are operated from the rest position to the transfer position as a result of the roll retaining arms 16 moving from the roll engaging position to the retracted position.

Although other kinds of depleted roll ejecting mechanisms can possibly be designed, the aforesaid embodiment is perhaps the best and simplest one.

To facilitate the operation of the transfer device 20, it can be provided with a handle member 40 downwardly projecting from a front side of the lower cup member 24, opposite to its hinged side, acting as a lever. The handle member 40 may extend across a whole width of the lower cup member 24 for easy handling. It may also extend for example only in the center or on the left or right side of the lower cup member 24.

The upper cup member 22 can conveniently have a top edge (opposite to its hinged side) of such thickness and profile as to introduce a minimal friction to efficiently separate the roll 6' contained in the upper cup member 22 from the next roll 6' directly above it. Such a rounded edge 41 can be profiled in the upper cup member 22 as shown, or consist of an upper edge with a free rotating roller (not shown) which, when the upper cup member 22 is engaged in the roll transfer, separates the roll 6' contained in the upper cup member 22 from the next roll 6' directly above with a minimal amount of friction.

Figure 6:
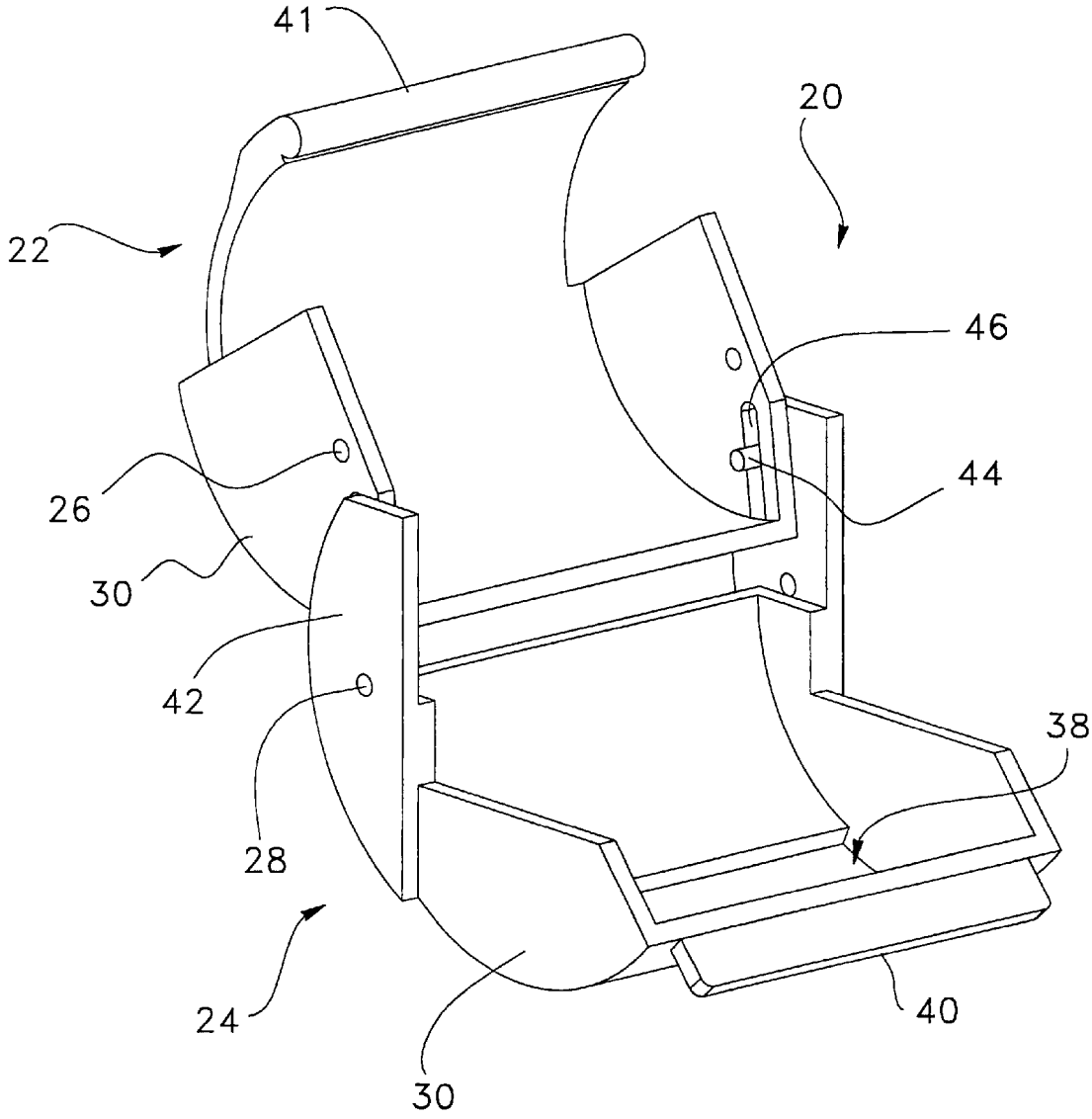
FIG. 6 is a schematic diagram illustrating the cup members of a transfer device of a multiple roll holder unit according to the present invention.

As shown in FIG. 6, the upper and lower cup members 22, 24 are hinged by a hinge arrangement which can slide on one of the cup members (the upper cup member 22 in the illustrated case) if a sliding motion between the cup members 22, 24 is required as a result of their design and assembly. In such a case, as an alternative, the sliding arrangement of one or both rotation axes of the cup members 22, 24 (not illustrated) could-possibly provide the same desired result, instead of providing the sliding function at the level of the hinge axis. The hinge arrangement may conveniently be formed of a pair of opposite side flanges 42 projecting behind the lower cup member 24 and provided with aligned pins 44 directed toward each other, and a pair of opposite side flanges such as the guiding side flanges 30 in the illustrated case, projecting on respective sides of the upper cup member 22 and having respective slots 46 in which the pins 44 of the lower cup member 24 pivotally slide. Other kinds of hinging arrangements can be used.

The roll holder 2 preferably extends at a downwardly and forwardly slanted position from the magazine 4 so that the rolls 6' are transferred from the magazine 4 to the roll holder 2 following a substantially forwardly declining course. The roll holder 2 may have a forwardly declining top wall 48 projecting from a front face 50 of the magazine 4 and extending above the roll holding area 18, for example to prevent dust from falling inside the roll holder 2 and for look purposes. The illustrated embodiment of the roll holder 2 has a roll access opening 52 extending in front and under the roll holding area 18. The roll access opening 52 could be limited to only on the front or under the roll holding area 18 if desired, and it could be arranged so that the paper passes through a slot (not illustrated).

Parts of the unit can be transparent or provided with windows (not illustrated) for easy inspection and visual indication that the magazine 4 is empty or that the roll 6 in the roll holder 2 is depleted. Although the unit has been described above in reference with toilet paper rolls, it should be understood that it can be easily adapted to store and hold other kinds of rolls, for example towel rolls, etc.

The unit can be wall mounted or in-wall mounted (recessed into a wall), using appropriate fasteners and/or brackets. It can also be set on a table if need be provided that the lower cup member 24 has enough space under it for moving and for the falling of a depleted roll.

The shape of the cup members 22, 24 may be different from the illustrated shape provided that they play their role as above described.

The unit according to the invention thus stores multiple toilet paper rolls 6' and dispense them one roll 6 at a time as needed. The rolls 6' are placed horizontally in the magazine 4 from the top. As seen above, the upper and lower cup members 22, 24 rotate on separate latitudinal axes 26, 28 in cooperation with each other. The lever formed by the handle member 40 on the lower cup member 24 controls the motion of both cup members 22, 24 and the spring loaded retaining arms 16.

Figure 2:
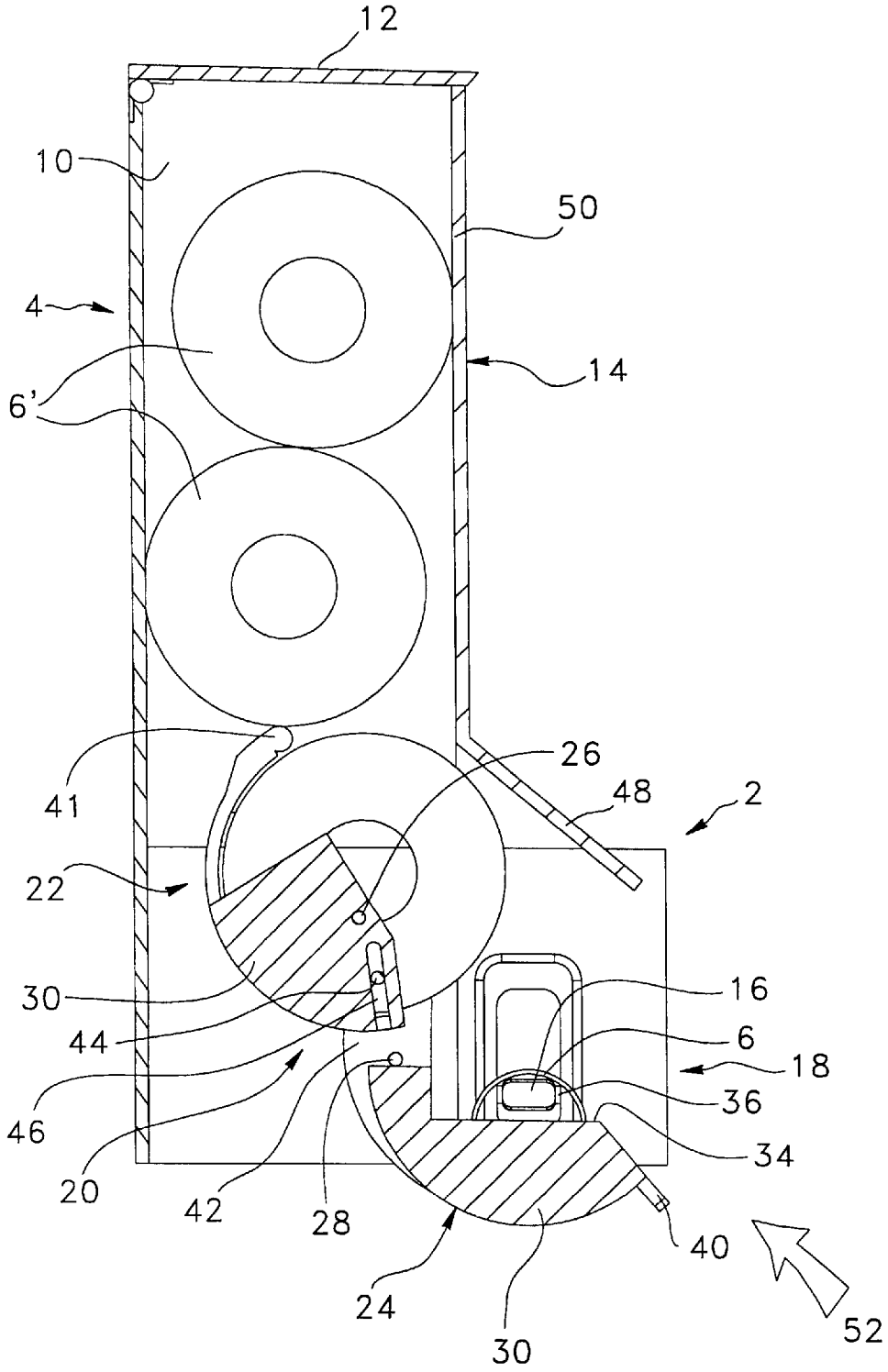
FIGS. 2–5 are cross-section views illustrating a multiple roll holder unit according to the present invention, at different stages for the replacement of a depleted toilet paper roll.
Figure 3:
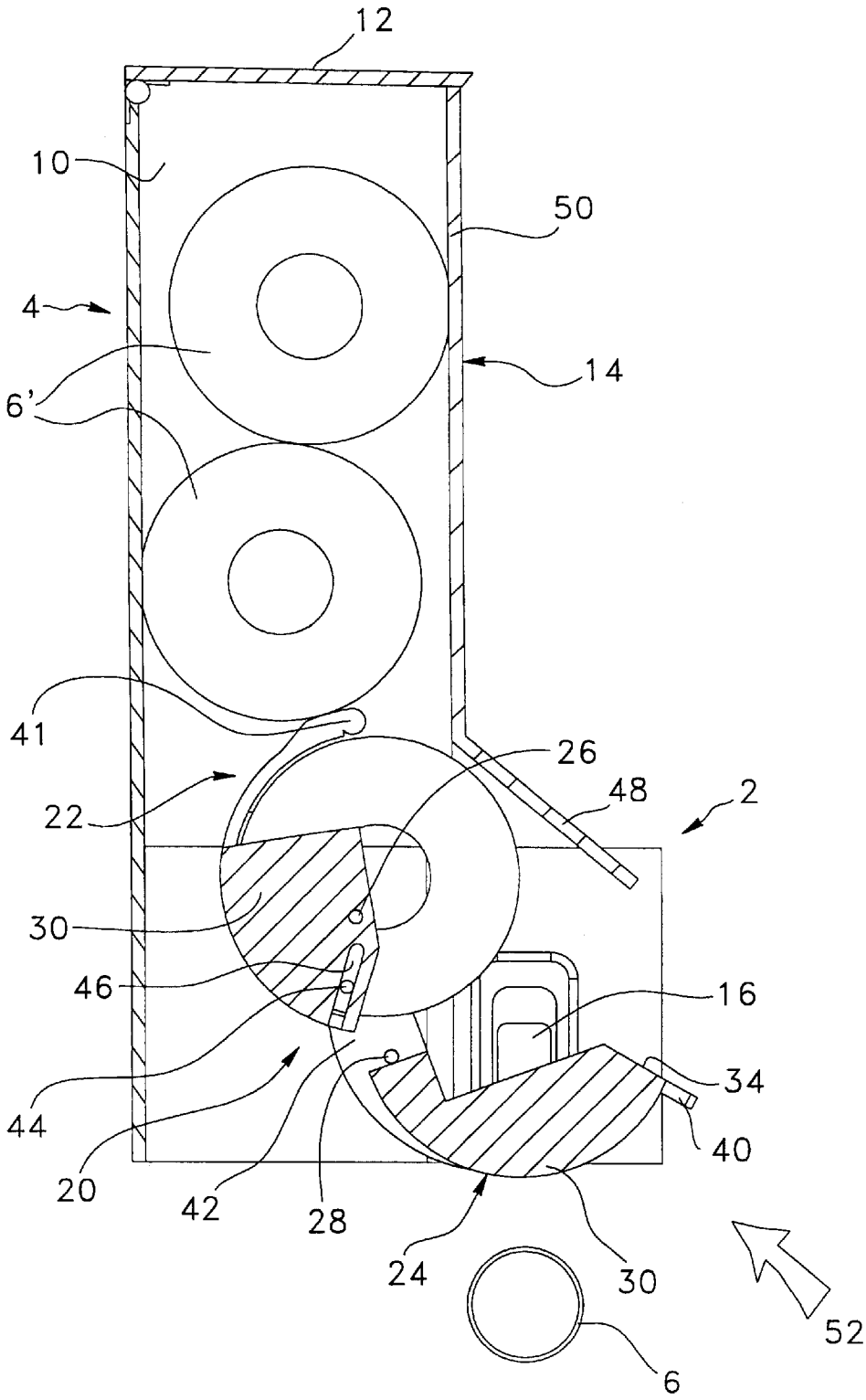
Figure 4:
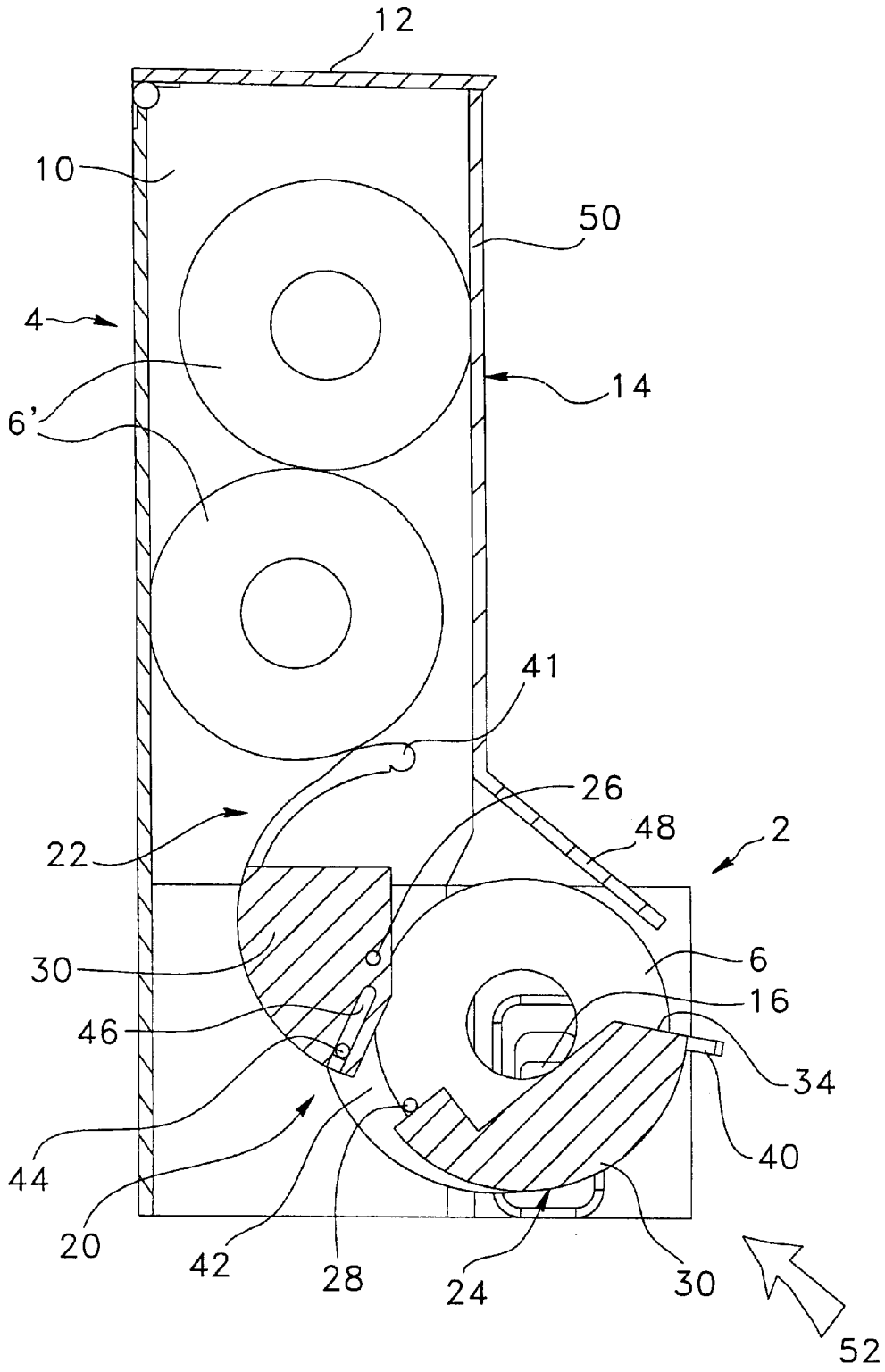

Initially, the rolls 6' are loaded in the magazine 4, and the lever on the lower cup member 24 is then grasped and upwardly rotated approximately 90 degrees (see FIGS. 2 and 3). This action transfers the lowermost roll 6' from the upper cup member 22 to the lower cup member 24 (see FIG. 4). In this position, the upper cup member 22 also retains the remaining rolls 6' in the magazine 4 (see FIG. 4) and the retaining arms 16 are pivoted out of the roll holding area 18. The lever is then rotated back down, thereby allowing the upper cup member 22 to receive the next roll 6' in the magazine 4 (see FIG. 5). The lower cup member 24 then releases the spring loaded retaining arms 16 which receive and suspend the new roll 6 in place for use in the roll holder 2. When the roll 6 is depleted, the same lever is grasped and rotated upwardly once again by approximately 90 degrees. Approximately midway through this rotation, the retaining arms 16 are retracted (see FIG. 3), thereby releasing the depleted roll 6 through the opening 38 in the lower cup member 24. As the rotation continues to approximately 90 degrees, the upper cup member 22 releases the next roll 6' into the lower cup member 24 while retaining the other rolls 6'. As the lever is released, the roll 6 retained by the upper cup member 22 falls into the upper cup member 22 as the lower cup member 24 releases the retaining arms 16 to suspend the new roll 6 for use.

One advantageous feature of the multiple roll holder unit according to the present invention is that it takes little side space as there is no inconvenient outwardly projecting side members. Furthermore, the actuating of the lever (from the lower cup member 24) not only reloads a new roll but also causes the direct dispensing of the depleted one, thereby improving the reliability of the roll dispensing and mounting operations.

While embodiments of this invention have been illustrated in the accompanying drawings and described above, it will be evident to those skilled in the art that changes and modifications may be made therein without departing from the essence of this invention. All such modifications or variations are believed to be within the scope of the invention as defined by the claims appended hereto.

What is claimed is:

1. A multiple roll holder unit comprising:

a magazine having a roll loading opening and an inner compartment in which rolls loaded in the magazine lay in a substantially stacked arrangement;

a roll holder extending on a lower portion of and in communication with the inner compartment of the magazine, the roll holder having a pair of roll retaining arms on opposite sides of a roll holding area, the roll retaining arms being moveable between a retracted position wherein the roll retaining arms are moved out of the roll holding area, and a roll engaging position wherein the roll retaining arms engage with and retain a roll in the roll holding area; and a transfer means for transferring a lowermost one of the rolls in the magazine to the roll holding area of the roll holder, the transfer means having:

upper and lower cup members hinged at one side with each other and having respective rotation axes extending for combined operation of the cup members between a rest position wherein the upper cup member is turned upwardly for receiving and holding the lowermost one of the rolls in the magazine while the lower cup member extends behind the roll holding area, and a transfer position wherein both cup members are turned toward each other until the roll held by the upper cup member falls on the lower cup member while the upper cup member provides support to a next one of the rolls in the magazine; and means operatively associated with the cup members for moving the roll retaining arms between the retracted and roll engaging positions as the cup members are respectively set in the transfer and rest positions.

2. The multiple roll holder unit according to claim 1, wherein the lower cup member has a transverse opening through which a depleted roll released by the roll holder falls when the cup members are operated from the rest position to the transfer position as a result of the roll retaining arms moving from the roll engaging position to the retracted position.

3. The multiple roll holder unit according to claim 1, wherein the transfer means comprises a handle member downwardly projecting from a side opposite to said one side of the lower cup member.

4. The multiple roll holder unit according to claim 3, wherein the handle member extends across a whole width of the lower cup member.

5. The multiple roll holder unit according to claim 1, wherein the cup members have opposite roll guiding side flanges guiding the rolls from the magazine to the roll holder.

6. The multiple roll holder unit according to claim 5, wherein:

the roll holder comprises opposite side walls spaced from each other, the roll retaining arms being respectively pivotally mounted onto facing sides of the side walls, the roll retaining arms having pivoting courses between the roll engaging and retracted positions wherein the roll retaining arms are respectively directed toward each other and upwardly pivoted against the side walls of the roll holder; and the guiding side flanges of the lower cup member extend respectively aside the facing sides of the side walls of the roll holder and have upper edges producing a lifting action on the roll retaining arms as the cup members are moved from the rest position to the transfer position, the means for moving being provided by the upper edges.

7. The multiple roll holder unit according to claim 6, wherein the roll holder comprises spring elements urging the roll retaining arms into the roll engaging position.

8. The multiple roll holder unit according to claim 1, wherein the upper cup member has a rounded edge opposite to said one side of the upper cup member.

9. The multiple roll holder unit according to claim 1, wherein the upper and lower cup members are hinged by a hinge arrangement which slides on one of the cup members.

10. The multiple roll holder unit according to claim 9, wherein the hinge arrangement comprises a pair of opposite side flanges projecting behind the lower cup member and provided with aligned pins directed toward each other, and a pair of opposite side flanges projecting on respective sides of the upper cup member and having respective slots in which the pins of the lower cup member pivotally slide.

11. The multiple roll holder unit according to claim 1, wherein the roll loading opening extends atop the inner compartment of the magazine, and the magazine is provided with a lid closing the roll loading opening.

12. The multiple roll holder unit according to claim 1, wherein the roll loading opening extends through a front face of the magazine at an upper portion thereof.

13. The multiple roll holder unit according to claim 1, wherein the roll holder extends at a downwardly and forwardly slanted position from the magazine so that the rolls are transferred from the magazine to the roll holder following a substantially forwardly declining course.

14. The multiple roll holder unit according to claim 13, wherein the roll holder has a forwardly declining top wall projecting from a front face of the magazine and extending above the roll holding area.

15. The multiple roll holder unit according to claim 1, wherein the inner compartment of the magazine has a rectangular cross section substantially matching a profile of the rolls so that the rolls loaded into the magazine form a column.

16. The multiple roll holder unit according to claim 1, wherein the roll holder has a roll access opening extending in front and under the roll holding area.

17. The multiple roll holder unit according to claim 7, wherein;

the lower cup member has a transverse opening through which a depleted roll released by the roll holder falls when the cup members are operated from the rest position to the transfer position as a result of the roll retaining arms moving from the roll engaging position to the retracted position;

the upper cup member has a rounded edge opposite to said one side of the upper cup member;

the transfer means comprises a handle member downwardly projecting from a side opposite to said one side of the lower cup member;

the upper and lower cup members are hinged by a hinge arrangement which slides on one of the cup members, the hinge arrangement comprising aligned pins projecting from the guiding side flanges of the lower cup member and directed toward each other, and respective slots in the guiding side flanges of the upper cup and in which the pins of the lower cup member pivotally slide;

the roll holder extends at a downwardly and forwardly slanted position from the magazine so that the rolls are transferred from the magazine to the roll holder following a substantially forwardly declining course, the roll holder having a forwardly declining top wall projecting from a front face of the magazine and extending above the roll holding area, and a roll access opening extending in front and under the roll holding area; and the inner compartment of the magazine has a rectangular cross section substantially matching a profile of the rolls so that the rolls loaded into the magazine form a column.

* * * * *